US007617110B2

(12) United States Patent
Kim et al.

(10) Patent No.: US 7,617,110 B2
(45) Date of Patent: Nov. 10, 2009

(54) LOSSLESS AUDIO DECODING/ENCODING METHOD, MEDIUM, AND APPARATUS

(75) Inventors: Junghoo Kim, Seoul (KR); Miao Lei, Beijing (CN); Shihwa Lee, Seoul (KR); Sangwook Kim, Seoul (KR); Ennmi Oh, Seoul (KR); Dohyung Kim, Hwaseong-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 915 days.

(21) Appl. No.: 11/066,431

(22) Filed: Feb. 28, 2005

(65) Prior Publication Data

US 2005/0192799 A1 Sep. 1, 2005

(30) Foreign Application Priority Data

Feb. 27, 2004 (KR) ..... 10-2004-0013681

(51) Int. Cl.
*G10L 19/00* (2006.01)

(52) U.S. Cl. ..... 704/501; 704/201; 704/200.1; 704/230

(58) Field of Classification Search ..... None
See application file for complete search history.

(56) References Cited

U.S. PATENT DOCUMENTS 6,675,148 B2 * 1/2004 Hardwick ..... 704/500
2005/0231396 A1 * 10/2005 Dunn ..... 341/50
2006/0200709 A1 * 9/2006 Yu et al. ..... 714/704

FOREIGN PATENT DOCUMENTS

WO WO 03/027940 4/2003

OTHER PUBLICATIONS

Li, "Embedded Audio Coding (EAC) With Implicit Auditory Masking", Proceedings of the tenth ACM international conference Multimedia'02, Dec. 1-6, 2002, Juan-les-Pins, France.*

(Continued)

*Primary Examiner*—David R Hudspeth
*Assistant Examiner*—Brian L Albertalli
(74) *Attorney, Agent, or Firm*—Staas & Halsey LLP

(57) ABSTRACT

A lossless audio encoding/decoding method, medium, and apparatus. The lossless audio encoding method includes converting an audio signal in a time domain into an audio spectral signal with an integer in a frequency domain, mapping the audio spectral signal in the frequency domain to a bit plane signal according to its frequency, and losslessly encoding binary samples of bit planes using a probability model determined according to a predetermined context. The lossless audio decoding method includes extracting a predetermined lossy bitstream and an error bitstream from error data by demultiplexing an audio bitstream, the error data corresponding to a difference between lossy encoded audio data and an audio spectral signal with an integer in a frequency domain, lossy decoding the extracted encoded lossy bitstream, losslessly decoding the extracted error bitstream, and restoring the original audio frequency spectral signal using the decoded lossy bitstream and error bitstream.

37 Claims, 10 Drawing Sheets

OTHER PUBLICATIONS

Oh, Eunmi, et al., "Improvement of coding efficiency in MPEG-4 audio scalable lossless coding (SLS)", ISO/IEC JTC1/SC29/WG11, MPEG2003/M10414, Dec. 2003.
Yu, R., et al., "A fine granular scalable perceptually lossy and lossless audio codec", 2003 IEEE International Conference on Multimedia and Expo Jul. 6-9, 2003 Baltimore, MD, USA., vol. 1, Jul. 6, 2003, pp. 1-65.
Taubman, David, et al., "Embedded, independent block-based coding of subband data", ISO/IED JTC 1/SC 29/WG1 N871, Jun. 23, 1998, paragraphs [11.2.3]—[11.2.5].
Yu, Rongshan, et al., "Advanced Audio Zip—A Scalable Perceptual and Lossless Audio Codec", ITU ISO/IEC JTC1/SC29/WG11 M9134, Dec. 2002, paragraphs [0001]—[0007].
Lian, Chung-Jr, et al., "Analysis and Architecture Design of Block-Coding Engine for EBCOT in JPEG 2000", IEEE Transactions on Circuits and Systems for Video Technology, IEEE Service Center, Piscataway, NJ, vol. 13, No. 3, Mar. 2003, paragraphs [0001], [0011], [IV, B].
European Search Report, dated Aug. 25, 2006, and issued in related European Application No. 05251075.7—2218.

* cited by examiner

LOSSLESS AUDIO DECODING/ENCODING METHOD, MEDIUM, AND APPARATUS

CROSS-REFERENCE TO RELATED APPLICATIONS

This application claims the benefit of Korean Patent Application No. 10-2004-0013681, filed on Feb. 27, 2004, in the Korean Intellectual Property Office, the disclosure of which is incorporated herein in its entirety by reference.

BACKGROUND OF THE INVENTION

1. Field of the Invention

Embodiments of the present invention relate to the field of audio signal encoding/decoding, and more particularly, to an apparatus, medium, and method for losslessly encoding/decoding an audio signal while adjusting a bit rate.

2. Description of the Related Art

Lossless audio encoding may be classified into Meridian Lossless Audio Compression (MLP: Meridian Lossless Packing), Monkey's Audio, and Free Lossless Audio Coding (FLAC). In particular, the MLP (Meridian Lossless Packing) can be applied to Digital Versatile Disc-Audio (DVD-A). Recent increases in Internet network bandwidth have made it possible to provide large amounts of differing multimedia content. When providing audio services, lossless audio encoding is required. The European Union (EU) has already initiated digital audio broadcasting through a Digital Audio Broadcasting (DAB) system, and broadcasting stations or content providers have adopted lossless audio encoding for digital audio broadcasting. In this connection, the ISO/IEC 14496-3:2001/AMD 5, Audio Scalable to Lossless Coding (SLS) standard is being developed as a standard for lossless audio encoding by the Motion Picture Experts Group (MPEG). This standard also supports Fine Grain Scalability (FGS) and enables lossless audio compression.

The compression rate, which is the most important factor in a lossless audio compression technique, can be improved by removing redundant information from data. The redundant information may be estimated and removed from adjacent data, or removed using the context of the adjacent data.

It is assumed that integer Modified Discrete Cosine Transform (MDCT) coefficients show a Laplacian distribution. In this case, Golomb coding leads to the optimum result of coding and bit plane coding is further required to provide FGS. A combination of Golomb coding and bit plane coding is referred to as Bit Plane Golomb Coding (BPGC), which allows audio data to be compressed at an optimum rate and provide FGS. However, there is a case where the above assumption cannot be applied. Since BPGC is an algorithm based on the above assumption, it is impossible to achieve the optimum compression rate when the integer MDCT coefficients do not show the Laplacian distribution. Accordingly, there is a growing need for development of lossless audio encoding/decoding that can guarantee optimum compression rates regardless of whether the integer MDCT coefficients show the Laplacian distribution.

SUMMARY OF THE INVENTION

Embodiments of the present invention provide lossless audio encoding methods, media, and apparatuses capable of achieving optimum compression rates regardless of whether integer Modified Discrete Cosine Transform (MDCT) coefficients show a Laplacian distribution.

Embodiments of the present invention further provide lossless audio decoding methods, media, and apparatuses capable of achieving optimum compression rates regardless of whether integer Modified Discrete Cosine Transform (MDCT) coefficients show the Laplacian distribution.

Additional aspects and/or advantages of the invention will be set forth in part in the description which follows and, in part, will be obvious from the description, or may be learned by practice of the invention.

According to an aspect of the present invention, there is provided a lossless audio encoding method including converting an audio signal in a time domain into an audio spectral signal with an integer in a frequency domain, mapping the audio spectral signal in the frequency domain to a bit plane signal according to its frequency, and losslessly encoding binary samples of bit planes using a probability model determined according to a predetermined context. The losslessly encoding of the binary samples may include mapping the audio spectral signal in the frequency domain to data of the bit planes according to its frequency, obtaining a most significant bit and a golomb parameter for each of the bit planes, selecting binary samples that are to be encoded from the bit planes in sequence from the most significant bit to a least significant bit and from a lowest frequency component to a highest frequency component, computing contexts of the selected binary samples using previously encoded samples present on the same bit plane including the selected binary samples, selecting a probability model using the obtained golomb parameter and the contexts, and losslessly encoding the binary samples using the probability model.

According to another aspect of the present invention, there is provided a lossless audio encoding method including converting an audio signal in a time domain to an audio spectral signal with an integer in a frequency domain, scaling the audio spectral signal in the frequency domain so that it can be matched to be input to a lossy encoding unit, lossy encoding the scaled signal to obtain lossy encoded data, computing an error-mapped signal that is a difference between the lossy encoded data and the audio spectral signal with the integer in the frequency domain, losslessly encoding the error-mapped signal using a context, and multiplexing the losslessly encoded signal and the lossy encoded signal to make a bitstream. The losslessly encoding of the error-mapped signal may include mapping the error-mapped signal to data of bit planes according to its frequency, obtaining a most significant bit and a golomb parameter of the bit planes, selecting binary samples that are to be encoded from the bit planes in sequence from the most significant bit to a least significant bit and from a lowest frequency component to a highest frequency component computing a context of the selected binary samples using previously encoded samples present on the same bit plane including the selected binary samples, selecting a probability model using the golomb parameter and the context, and losslessly encoding the selected binary samples using the probability model.

During the computing of the context of the selected binary samples, a scalar value of the previously encoded samples present on the same bit plane including the selected binary samples may be obtained, and the context of the selected binary samples may be computed using the scalar value. During the computing of the context of the selected binary samples, a probability that predetermined samples will have a value of 1 may be computed, the probability may be multiplied by a predetermined integer to obtain an integral probability, and the context of the selected binary samples may be computed using the integral probability, the predetermined samples being present on the same bit plane including the selected binary samples. During the computing of the context of the selected binary samples, the context of the selected binary samples may be computed using already encoded upper bit plane values at the same frequency where the selected binary samples are located. During the computing of the context of the selected binary samples, the context of the selected binary samples may be computed using information regarding whether already encoded upper bit plane values at the same frequency are present, and the context may be determined to have a value of 1 when at least one of the upper bit plane values is 1, and determined to have a value of 0 otherwise.

According to yet another aspect of the present invention, there is provided a lossless audio encoding apparatus including an integer time-to-frequency converter converting an audio signal in a time domain into an audio spectral signal with an integer in a frequency domain, and a lossless encoding unit mapping the audio spectral signal in the frequency domain to data of bit planes according to its frequency and losslessly encoding binary samples of the bit planes using a predetermined context. The lossless encoding unit includes a bit plane mapper mapping the audio spectral signal in the frequency domain to the data of the bit planes according to its frequency, a parameter obtaining unit obtaining a most significant bit and a golomb parameter for the bit plane, a binary sample selector selecting the binary samples from the bit planes in sequence from the most significant bit to a least significant bit and from a lowest frequency component to a highest frequency component, a context calculator computing contexts of the selected binary samples using previously encoded samples present on the same bit plane including the selected binary samples; a probability model selector selecting a probability model using the golomb parameter and the computed contexts, and a binary sample encoder losslessly encoding the selected binary samples using the probability model. The integer time-to-frequency converter may perform integer modified discrete cosine transform.

According to still another aspect of the present invention, there is provided a lossless audio encoding apparatus including an integer time-to-frequency converter converting an audio signal in a time domain into an audio spectral signal with an integer in a frequency domain, a scaling unit scaling the audio spectral signal so that the audio spectral signal can be matched to be input to a lossy encoding unit, the lossy encoding unit lossy encoding the scaled signal, an error mapper computing a error-mapped signal that is a difference between the lossy encoded signal and the audio spectral signal generated by the integer time-to-frequency converter, a lossless encoding unit losslessly encoding the error-mapped signal using a context, and a multiplexer multiplexing the lossy encoded signal and the losslessly encoded signal to make a bitstream. The lossless encoding unit includes a bit plane mapper mapping the error-mapped signal to data of bit planes according to its frequency; a parameter obtaining unit obtaining a most significant bit and a golomb parameter of the bit planes, a binary sample selector selecting binary samples from the bit planes in sequence from the most significant bit to a least significant bit and from a lowest frequency component to a highest frequency component, a context calculator computing a context of the selected binary samples using previously encoded samples present on the same bit plane including the selected binary samples; a probability model selector selecting a probability model using the golomb parameter and the computed context, and a binary sample encoder losslessly encoding the selected binary samples using the probability model.

According to still another aspect of the present invention, there is provided a lossless audio decoding method including obtaining a golomb parameter from audio data, selecting binary samples that are to be decoded from bit planes in sequence from a most significant bit to a least significant bit and from a lowest frequency component to a highest frequency component, computing predetermined contexts using already decoded samples; selecting a probability model using the golomb parameter and the contexts; arithmetically decoding the selected binary samples using the probability model; and repeatedly performing the selecting of binary samples, the computing of a predetermined contexts, the selecting of a probability model, and the arithmetically decoding of the selected binary samples until all the selected binary samples are decoded. The computing of the predetermined contexts may include computing a first context using already decoded samples present on the same bit plane including the selected binary samples; and computing a second context using already decoded upper bit plane samples at the same frequency where the selected binary samples are located.

According to still another aspect of the present invention, there is provided a lossless audio decoding method including extracting a predetermined lossy bitstream that is lossy encoded and an error bitstream from error data by demultiplexing an audio bitstream, the error data corresponding to a difference between lossy encoded audio data and an audio spectral signal with an integer in a frequency domain, lossy decoding the extracted encoded lossy bitstream, losslessly decoding the extracted error bitstream, restoring the original audio frequency spectral signal using the decoded lossy bitstream and error bitstream, and restoring the original audio signal in a time domain by performing inverse integer time-to-frequency conversion on the audio spectral signal. The losslessly decoding of the extracted error bitstream may include obtaining a golomb parameter from a bitstream of the audio data, selecting binary samples that are to be decoded in sequence from a most significant bit to a least significant bit and from a lowest frequency component to a highest frequency component, computing predetermined contexts using already decoded samples, selecting a probability model using the golomb parameter and the contexts, arithmetically decoding the selected binary samples using the probability model, and repeating the selecting of binary samples, the computing of predetermined contexts, the selecting of the probability model, and the arithmetically decoding of the selected binary samples until all samples of bit planes are decoded. The computing of predetermined contexts may include computing a first context using already decoded samples on the same bit plane including the selected binary samples, and computing a second context using already decoded upper bit plane samples at the same frequency where the selected binary samples are located.

According to still another aspect of the present invention, there is provided a lossless audio decoding apparatus including a parameter obtaining unit obtaining a golomb parameter from a bitstream of audio data, a sample selector selecting binary samples that are to be decoded in sequence from a most significant bit to a least significant bit and from a lowest frequency component to a highest frequency component, a context calculating unit computing predetermined contexts using already decoded samples, a probability model selector selecting a probability model using the golomb parameter and the contexts, and an arithmetic decoder arithmetically decoding the selected binary samples using the probability model. The context calculating unit may include a first context calculator computing a first context using already decoded samples present on the same bit plane including the selected binary samples, and a second context calculator computing a second context using already decoded upper bit plane samples at the same frequency where the selected binary samples are located.

According to still another aspect of the present invention, there is provided a lossless audio decoding apparatus including a demultiplexer demultiplexing an audio bitstream to extract a predetermined lossy bitstream that is lossy encode and an error bitstream from error data which corresponds to a difference between lossy encoded audio data and an audio spectral signal with an integer in a frequency domain; a lossy decoding unit lossy encoding the extracted lossy bitstream, a lossless decoding unit losslessly decoding the extracted error bitstream, an audio signal composition unit combining the decoded lossy bitstream and error bitstream to restore the audio frequency spectral signal, and an inverse integer time-to-frequency converter performing inverse integer time-to-frequency conversion on the restored audio frequency spectral signal to restore the original audio signal in a time domain.

The lossy decoding unit may be an AAC decoder. The lossless audio decoding apparatus may further include an inverse time-to-frequency converter restoring the lossy bitstream decoded by the lossy decoding unit to the audio signal in the time domain. The lossy decoding unit includes a parameter obtaining unit obtaining a golomb parameter from the bitstream of the audio data; a sample selector selecting binary samples that are to be decoded in sequence from a most significant bit to a least significant bit and from a lowest frequency component to a highest frequency component; a context calculating unit computing predetermined contexts using already decoded samples, a probability model selector selecting a probability model using the golomb parameter and the contexts; and an arithmetic decoder arithmetically decoding the selected binary samples using the probability model.

The context calculating unit may include a first context calculator computing a first context using already decoded samples present on the same bit plane including the selected binary samples, and a second context calculator computing a second context using already decoded upper bit plane samples at the same frequency where the selected binary samples are located.

According to still another aspect of the present invention, there is provided a medium comprising computer readable code implementing method embodiments of the present invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
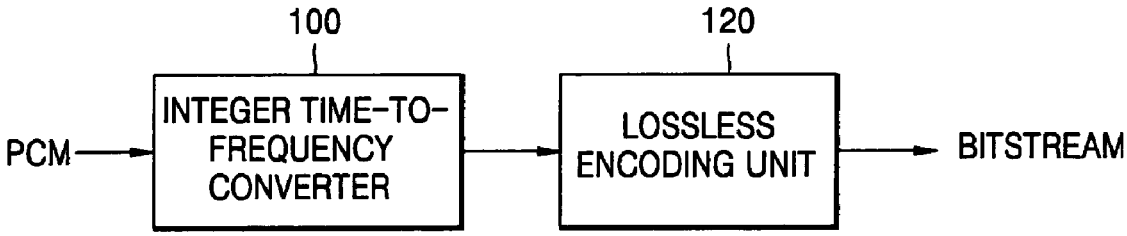
FIG. 1 is a block diagram of a lossless audio encoding apparatus, according to an embodiment of the present invention.

Reference will now be made in detail to embodiments of the present invention, examples of which are illustrated in the accompanying drawings, wherein like reference numerals refer to the like elements throughout. The embodiments are described below to explain the present invention by referring to the figures.

A lossless audio encoding/decoding method and apparatus, according to an embodiment of the present invention will now be described in detail. In general, Fine Grain Scalability (FGS) is provided for audio encoding and Integer Modified Discrete Cosine Transform (MDCT) is performed for lossless audio encoding. In particular, when input samples of an audio signal show a Laplacian distribution, Bit Plane Golomb Coding (BPGC) brings out the most favorable result of coding. A result of BPGC is known to be equivalent to that of Golomb coding. A Golomb parameter L can be obtained by For(L=0; (N<<L+1))<=A;L++). According to the Golomb coding, the probability that a bit plane, that is smaller than the Golomb parameter L, will have a value of 0 or 1 is ½. However, in this case, it is possible to obtain the optimum encoding results only when the input samples of the audio signal show the Laplacian distribution. Accordingly, embodiments of the present invention provide optimum compression rates using the context of data and statistical analysis even if distribution of data is different from the Laplacian distribution.

FIG. 1 is a block diagram of a lossless audio encoding apparatus, according to an embodiment of the present invention. The lossless audio encoding apparatus of FIG. 1 includes an integer time-to-frequency converter 100 and a lossless encoding unit 120. The integer time-to-frequency converter 100 converts an audio signal in a time domain into an audio spectral signal with an integer in a frequency domain, preferably using integer MDCT. The lossless encoding unit 120 maps the audio signal in the frequency domain to data of bit planes according to its frequency and losslessly encodes binary samples making up the bit plane using a predetermined context. The lossless encoding unit 120 includes a bit plane mapper 200, a Golomb parameter obtaining unit 210, a binary sample selector 220, a context calculator 230, a probability model selector 240, and a binary sample encoder 250.

Figure 8:
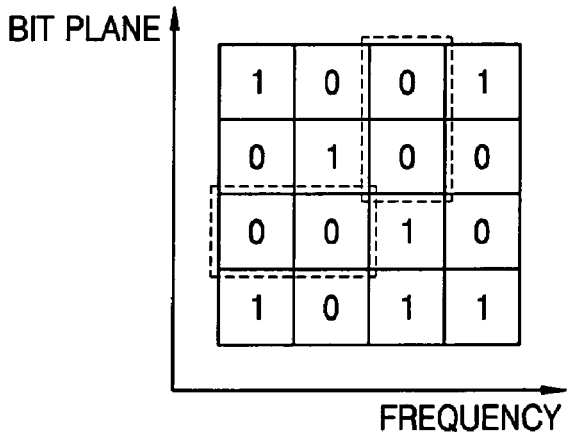
FIG. 8 illustrates an audio signal mapped to data of a bit plane according to its frequency.

The bit plane mapper 200 maps the audio signal in the frequency domain to the data of the bit planes according to its frequency. FIG. 8 illustrates an audio signal mapped to data of a bit plane according to its frequency.

The Golomb parameter obtaining unit 210 obtains a Most Significant Bit (MSB) and a Golomb parameter of the bit planes. The binary sample selector 220 selects the binary samples from the bit planes, which are to be encoded, in sequence from the MSB to a Least Significant Bit (LSB) and from a lowest frequency component to a highest frequency component.

The context calculator 230 computes the context of the selected binary samples using previously encoded binary samples located on the bit plane including the selected binary samples. The probability model selector 240 selects a probability model using the obtained Golomb parameter and the computed context. The binary sample encoder 250 losslessly encodes the selected binary samples using the selected probability model.

Figure 3:
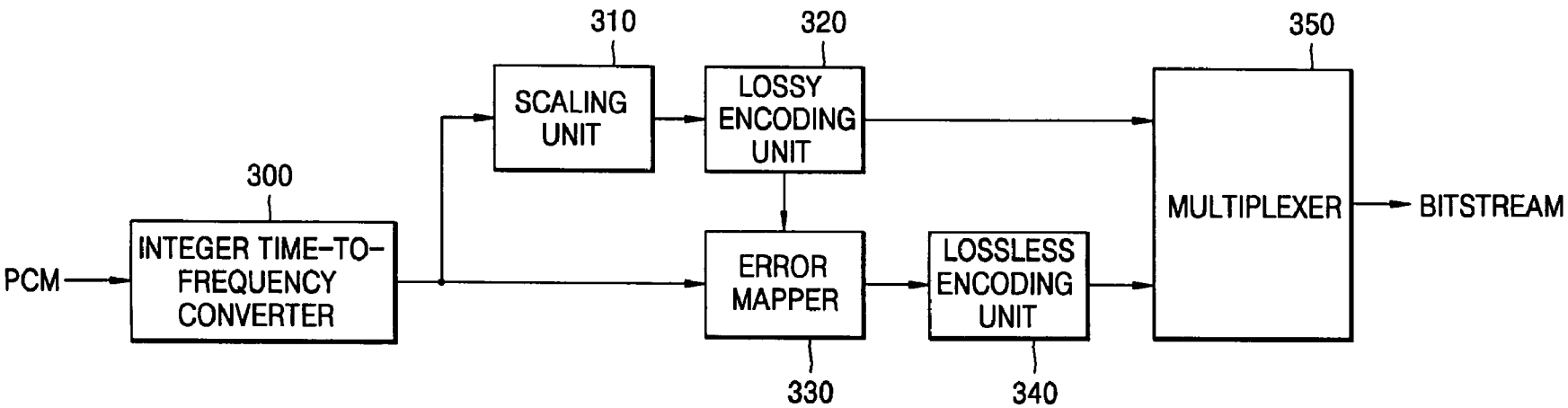
FIG. 3 is a block diagram of a lossless audio encoding apparatus, according to another embodiment of the present invention.

FIG. 3 is a block diagram of a lossless audio encoding, apparatus according to another embodiment of the present invention. The lossless audio encoding apparatus of FIG. 3 includes an integer time-to-frequency converter 300, a scaling unit 310, a lossy encoding unit 320, an error mapper 330, a lossless encoding unit 340, and a multiplexer 350.

The integer time-to-frequency converter 300 converts an audio signal in a time domain into an audio spectral signal with an integer in a frequency domain. In this case, integer MDCT is preferably performed for this conversion. The scaling unit 310 scales the audio frequency signal output from the integer time-to-frequency converter 300 so that it can be matched for input to the lossy encoding unit 320. The audio frequency signal output from the integer time-to-frequency converter 300 is represented with an integer, and therefore, cannot be input directly to the lossy encoding unit 320. Thus, the audio frequency signal must be scaled by the scaling unit 310 so that it can be input to the lossy encoding unit 320.

The lossy encoding unit 320 lossy encodes the scaled audio frequency signal, preferably using an AAC core encoder (not shown). The error mapper 330 obtains an error-mapped signal that is the difference between the lossy encoded signal and the audio frequency signal output from the integer time-to-frequency converter 300. The lossless encoding unit 340 losslessly encodes the error-mapped signal using the context. The multiplexer 350 multiplexes the losslessly encoded signal and the lossy encoded signal so as to make a bitstream.

Figure 4:
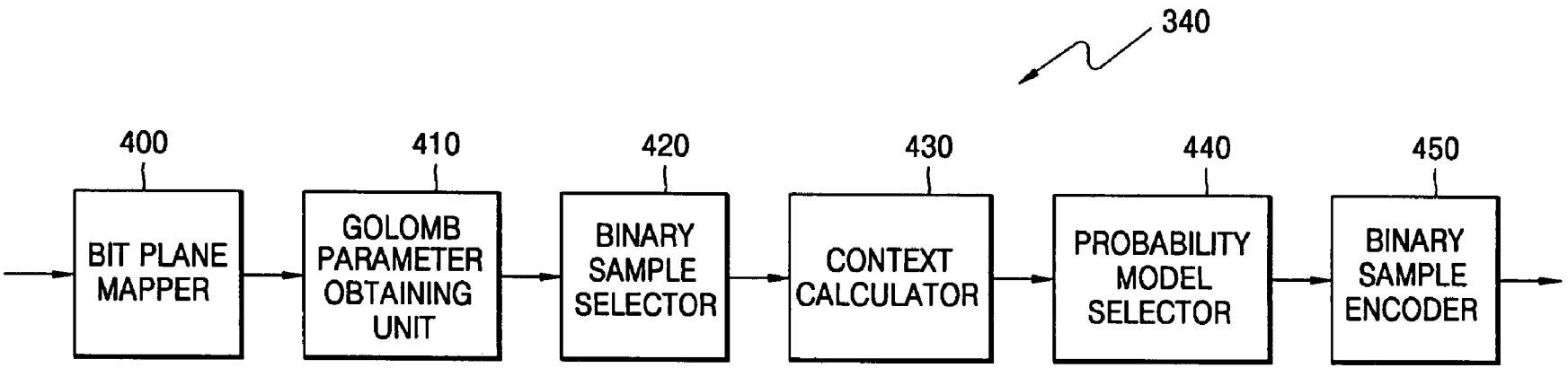
FIG. 4 is a block diagram of a lossless encoding unit of FIG. 3.

FIG. 4 is a block diagram of the lossless encoding unit 340 of FIG. 3. The lossless encoding unit 340 includes a bit plane mapper 400, a parameter obtaining unit 410, a binary sample selector 420, a context calculator 430, a probability model selector 440, and a binary sample encoder 450.

The bit plane mapper 400 maps the error-mapped signal generated by the error mapper 330 to data of bit planes according to its frequency. The parameter obtaining unit 410 obtains an MSB and a Golomb parameter of the bit planes. The binary sample selector 420 selects binary samples from the bit planes in sequence from the MSB to an LSB and from a lowest frequency component to a highest frequency component. The context calculator 430 computes the context of the selected binary samples using previously encoded binary samples located on the bit planes including the selected binary samples. The probability model selector 440 selects a probability model using the obtained Golomb parameter and the computed context. The binary sample encoder 450 losslessly encodes the selected binary samples using the probability model.

Figure 2:
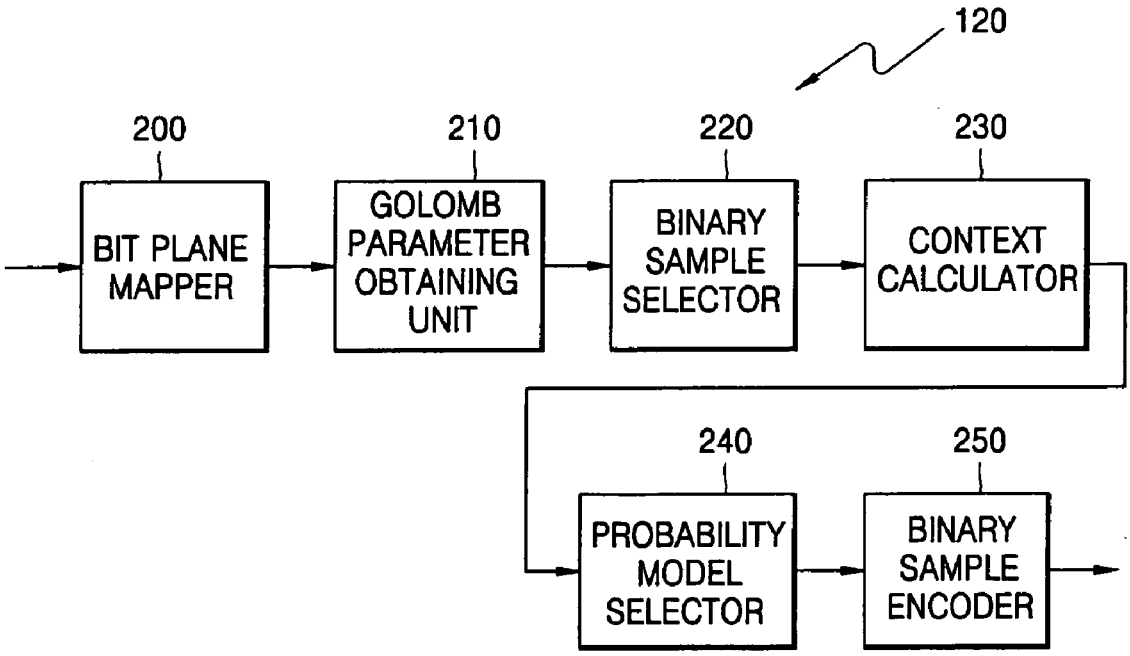
FIG. 2 is a detailed block diagram of a lossless encoding unit of FIG. 1.

The context calculators 230 and 430 of FIGS. 2 and 4 are capable of changing the previously encoded binary samples located on the bit plane including the selected binary samples into a scalar value and computing the context of the selected binary samples using the scalar value. Alternatively, the context calculators 230 and 430 may compute a probability that predetermined samples, located on the bit plane including the selected binary samples, will have a value of 1, multiply the probability by a predetermined integer to obtain an integer, and compute the context of the selected binary samples using the integer. Also, the context calculators 230 and 430 may compute the context using values of already encoded upper bit plane at the same frequency where the selected binary samples are located. Also, based on information regarding whether the already encoded upper bit plane values are present, the context may be determined as 1 when at least one of the upper bit plane values is '1' and determined as 0 otherwise.

Figure 5:
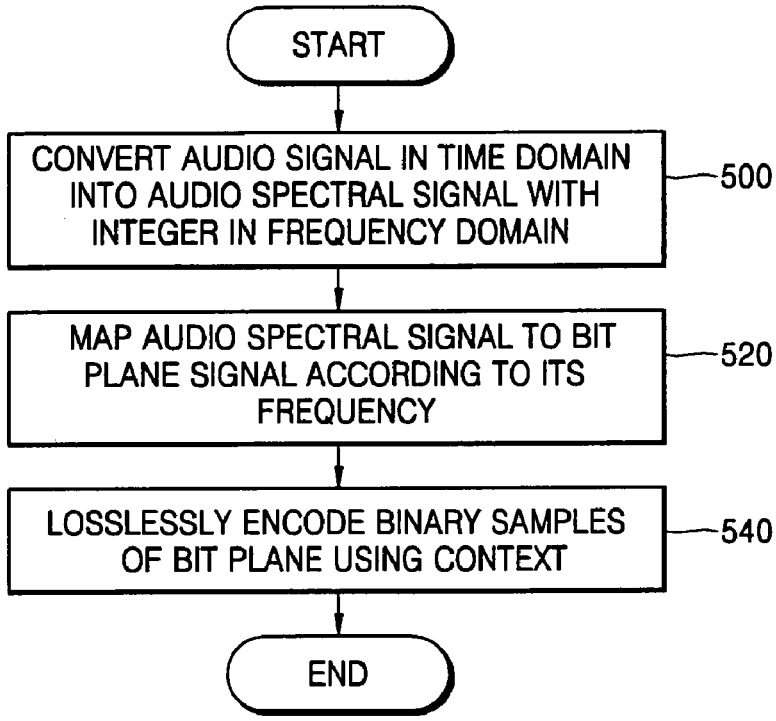
FIG. 5 is a flowchart of an operation of the lossless audio encoding apparatus of FIG. 1, according to an embodiment of the present invention.

FIG. 5 is a flowchart of the operation of the lossless audio encoding apparatus of FIG. 1 according to an embodiment of the present invention. Referring to FIG. 5, when a Pulse Code Modulation (PCM) signal corresponding to an audio signal in a time domain is input to the integer time-to-frequency converter 100, the integer time-to-frequency converter 100 converts this signal into an audio spectral signal with an integer in a frequency domain (operation 500). For this conversion, integer MDCT is preferably performed. Next, the audio spectral signal in the frequency domain is mapped to a bit plane signal according to its frequency as shown in FIG. 8 (operation 520). Next, binary samples of the bit planes are losslessly encoded using a probability model determined by a predetermined context (operation 540).

Figure 6:
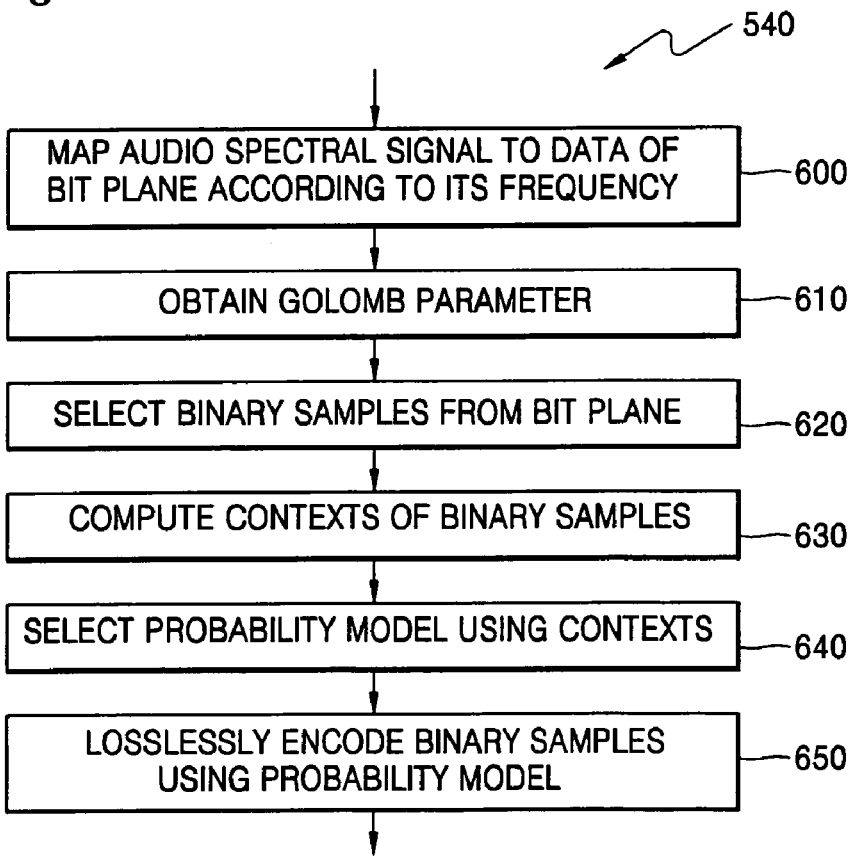
FIG. 6 is a flowchart of an operation of the lossless encoding unit of FIG. 1, according to an embodiment of the present invention.

FIG. 6 is a flowchart of an operation of the lossless encoding unit 120 of FIG. 1, according to an embodiment of the present invention. Referring to FIG. 6, when the audio spectral signal in the frequency domain is input to the bit plane mapper 200, the audio spectral signal in the frequency domain is mapped to data of the bit planes according to its frequency (operation 600). Next, an MSB and a Golomb parameter of the bit planes are obtained by the Golomb parameter obtaining unit 210 (operation 610). Next, the binary sample selector 220 selects binary samples that are to be encoded from the bit planes in sequence from the MSB to an LSB and from a lowest frequency component to a highest frequency component (operation 620). Next, the context of the selected binary samples are computed using previously encoded binary samples located on the bit plane including the selected binary samples (operation 630). Next, a probability model is selected using the Golomb parameter obtained by the Golomb parameter obtaining unit 210 and the context computed by the context calculator 230 (operation 640). Thereafter, the selected binary samples are losslessly encoded using the probability model (operation 650)

Figure 7:
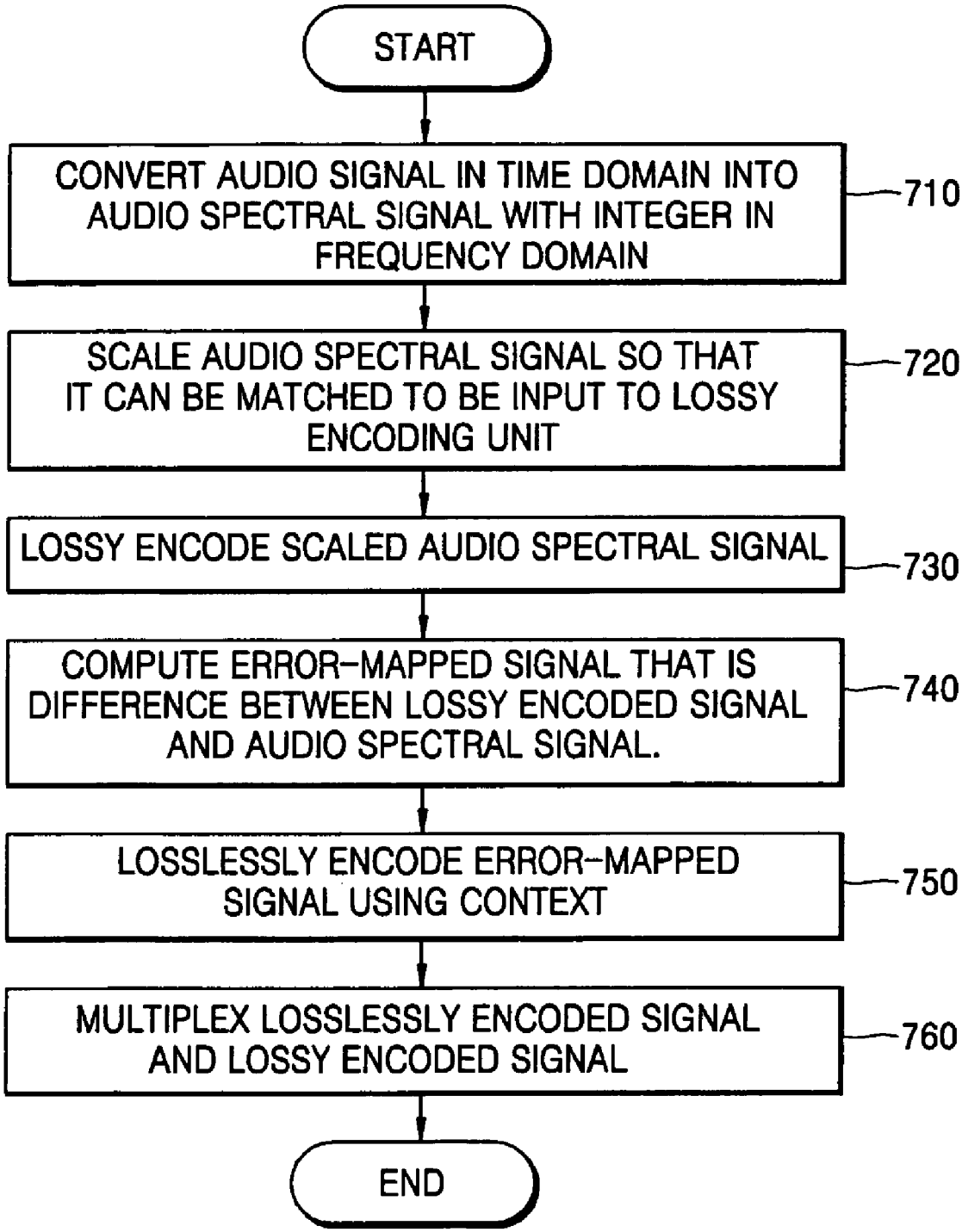
FIG. 7 is a flowchart of an operation of the lossless audio encoding apparatus of FIG. 3, according to an embodiment of the present invention.

FIG. 7 is a flowchart of an operation of the lossless encoding unit of FIG. 3, according to an embodiment of the present invention. Referring to FIG. 3, an audio signal in a time domain is converted into an audio spectral signal with an integer in the frequency domain by the integer time-to-frequency converter 300 (operation 710).

Next, the audio spectral signal in the frequency domain is scaled by the scaling unit 310 so that it can be matched for input to the lossy encoding unit 320 (operation 720). Next, the scaled audio spectral signal is lossy encoded by the lossy encoding unit 320 (operation 730). An AAC core encoder is preferably used for the lossy encoding of the scaled audio spectral signal, but embodiments of the present invention are not limited thereto.

Next, the error mapper 330 obtains an error-mapped signal that is the difference between the lossy encoded signal and the audio spectral signal with the integer in the frequency domain (operation 740). Next, the lossless encoding unit 340 losslessly encodes the error-mapped signal using a context (operation 750).

Next, the multiplexer 350 multiplexes the losslessly encoded signal generated by the lossless encoding unit 340 and the lossy encoded signal generated by the lossy encoding unit 320 so as to make a bitstream (operation 760).

During operation 750, the error-mapped signal is mapped to a bit plane signal according to its frequency, and then, operations similar to operations 610 through 650 of FIG. 6 are performed.

FIG. 8 illustrates a range of samples selected from a bit plane for computation of the context of samples that are to be encoded, the bit plane including the samples that are to be encoded samples. A portion indicated by a dotted line denotes samples available to compute the distribution of a probability of the samples that are to be encoded.

In general, performing MDCT causes a spectral leakage that generates correlation between neighborhood samples on a frequency axis. In other words, if the value of an adjacent sample is X, it is highly probable that the value of a current sample approximates X. Accordingly, when adjacent samples are selected for computation of a context, it is possible to improve a compression rate using the correlation therebetween.

Statistics reveals that upper bit plane values are closely related to the distribution of lower samples. Thus, when adjacent samples are selected for the computation of the context, it is possible to improve the compression rate using the correlation therebetween.

Computation of a context will now be described. Already encoded samples present on the same bit plane, including selected samples for encoding, can be used for the computation of the context. There are various methods of computing a context using the already encoded samples. Representative methods will be described hereinafter.

In a first method, the values of the already encoded binary samples with a predetermined length on the same bit plane are changed into a scalar value that will be used as a context. It is assumed that four of the already encoded binary samples are used for computation of the context. For example, if the four binary samples represent values of 0100, 0100 are considered as a binary number, i.e., 0100(2), and 0100(2) represents 4, the value of the context is determined to be 4. In this case, it is highly probable that a current sample has a value of 1. In some cases, a range of a context value is limited in consideration of the size of a model. In general, a context value may have a range from 8 to 16.

In a second method, a number 1 present on the same bit plane is counted, and a probability that already encoded samples will have a value of 1 is computed. Next, an integer value is obtained by multiplying the probability that already encoded samples will have a value of 1 by an integer N. If the obtained integer is 0, none of the already encoded samples will have a value of 1. In this case, the samples that are to be encoded are very likely to have a value of 1. If the obtained integer approximates the integer N, most of the already encoded samples have a value of 1, and thus, the samples that are to be encoded are likely to have a value of 0. In some cases, a range of a context value is limited based on the size of a model. In general, the context value may again have a range from 8 to 16.

Upper bit plane samples at the same frequency, where the samples that are to be encoded are present, may be used for context computation. There are various methods of computing the context using the already encoded samples. Representative methods will be described hereinafter.

In a first method, already encoded upper bit plane values are used for context computation. If the upper bit plane samples, representing values of 0110, 0100, are considered as a binary number, i.e., 0110(2), and 0110(2) represents 6, the value of the context can be determined to be 6. In some cases, a range of the context value is again based on the size of a model. Similar to above, in general, a context value has a range from 8 to 16.

In a second method, information regarding whether already encoded upper bit plane values are present is used for context computation. A context value is determined to be 1 when there is at least one of the upper bit plane values is 1 and determined to be 0 otherwise. That is, if an MSB has yet to be encoded, it is highly probable that a current to be encoded sample has a value of 1.

Here, it can be assumed that a fourth sample of a third bit plane will be encoded, the fourth sample may have a value of 0, a Golomb parameter is 4. A context of samples that is present on same bit plane will be calculated.

The first method of obtaining context on the same bit plane is used. First, according to the first method, the samples represent a binary value of 001(2), and thus, their context value(context1) is 1. Second, samples at the same frequency represent a binary value of 10(2), and thus, their context value(context2) is 2.

Thus, a probability model is selected using the above three parameters, i.e., the Golomb parameter with a value of 4, the context value of 1, and the context value of 2. The probability model may be expressed as Prob[Golomb][Context1][Context2], which is a representation of a three-dimensional arrangement.

Then, an audio signal is losslessly encoded using the probability model. Arithmetic encoding may be used for losslessly encoding an audio signal.

Figure 9:
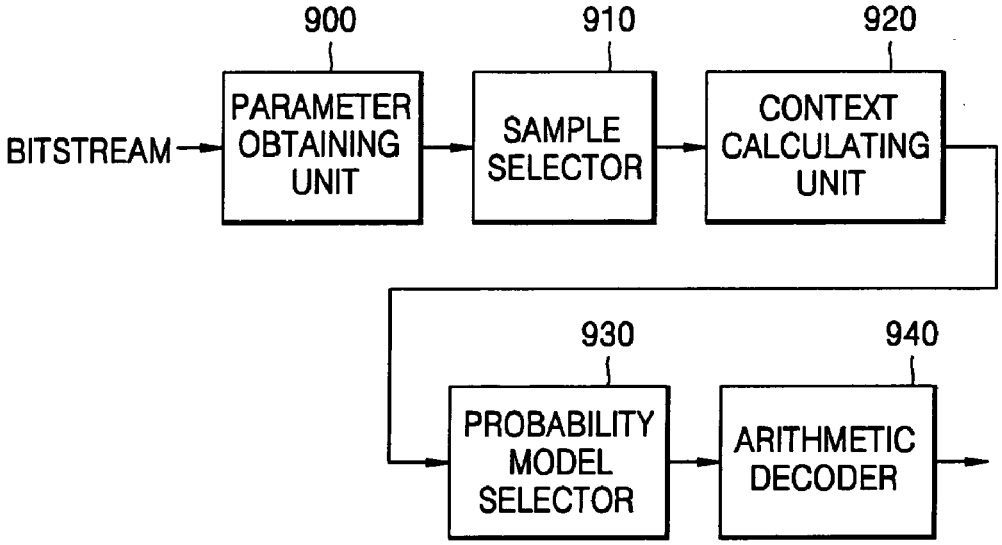
FIG. 9 is a block diagram of a lossless audio decoding unit, according to an embodiment of the present invention.

A lossless audio decoding apparatus and method, according to embodiments of the present invention will now be described. FIG. 9 is a block diagram of a lossless audio decoding apparatus according to an embodiment of the present invention. The apparatus of FIG. 9 includes a parameter obtaining unit 900, a sample selector 910, a context calculating unit 920, a probability model selector 930, and an arithmetic decoder 940.

When a bitstream of audio data is input to the parameter obtaining unit 900, the parameter obtaining unit 900 obtains an MSB and a Golomb parameter from the bitstream. The sample selector 910 selects binary samples that are to be decoded in sequence from the MSB to an LSB and from a lowest frequency component from a highest frequency component.

Figure 10:
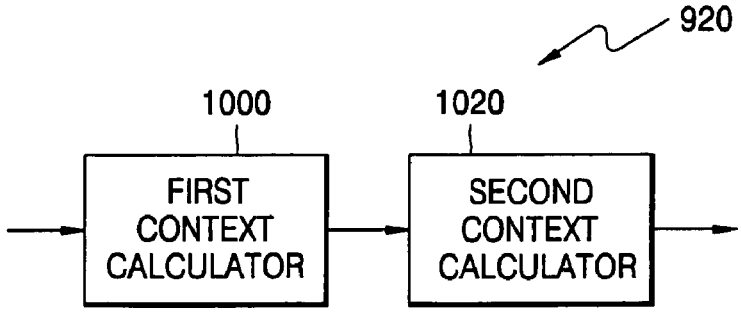
FIG. 10 is a detailed block diagram of a context calculating of FIG. 9.

The context calculating unit 920 computes predetermined context values using already decoded samples. The context calculating unit 920 includes a first context calculator 1000 and a second context calculator 1020, as shown in FIG. 10. The first context calculator 1000 calculates a first context using the already decoded sample present on the bit plane including the selected binary samples. The second context calculator 1020 computes a second context using already decoded upper bit plane samples at the same frequency where the selected binary samples are located.

The probability model selector 930 selects a probability model using the Golomb parameter obtained by the parameter obtaining unit 900 and the contexts computed by the context calculator 920. The arithmetic decoder 940 arithmetically decodes the selected binary samples using the probability model.

Figure 11:
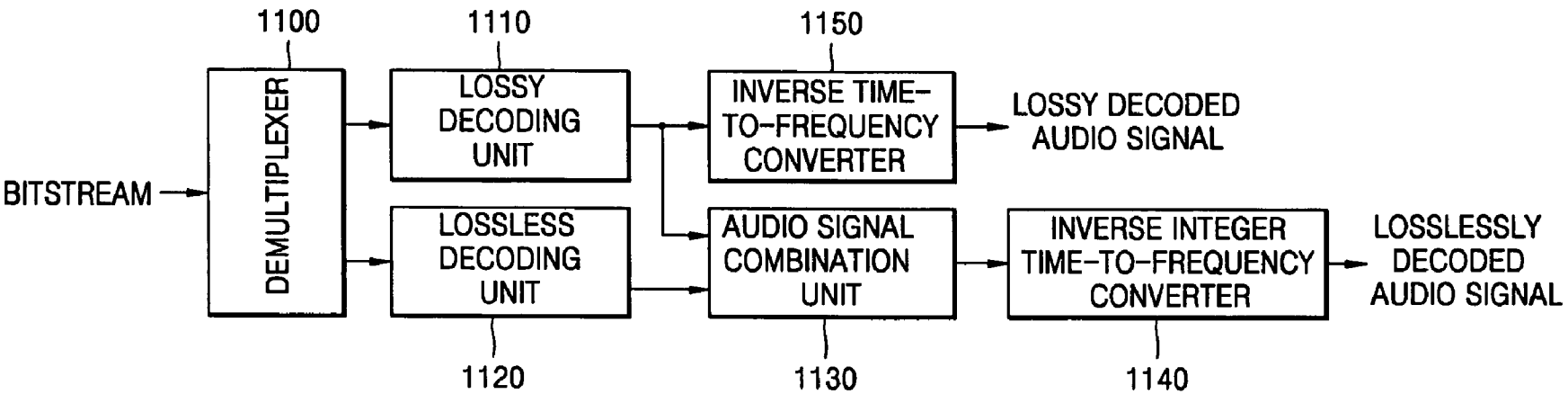
FIG. 11 is a block diagram of a lossless audio decoding unit, according to another embodiment of the present invention.

FIG. 11 is a block diagram of a lossless audio decoding apparatus according to another embodiment of the present invention. The apparatus of FIG. 11 includes a demultiplexer 1100, a lossy decoding unit 1110, a lossless decoding unit 1120, an audio signal composition unit 1130, and an inverse integer time-to-frequency converter 1140. The apparatus preferably further includes an inverse time-to-frequency converter 1150.

When an audio bitstream is input to the demultiplexer 1100, the demultiplexer 1100 demultiplexes the audio bitstream to extract a lossy bitstream generated when the bitstream is encoded using a predetermined lossy encoding method and an error bitstream of error data.

The lossy decoding unit 1110 lossy decodes the lossy bitstream using a lossy decoding method corresponding to the lossy encoding method adopted to encode the bitstream. The lossless decoding unit 1120 losslessly decodes the error bitstream extracted by the demultiplexer 1100 using a lossless decoding method corresponding to a lossless decoding method adopted to encode the bitstream.

The audio signal composition unit 1130 combines the decoded lossy bitstream and the error bitstream to obtain the original frequency spectral signal. The inverse integer time-to-frequency converter 1140 performs inverse integer time-to-frequency conversion on the frequency spectral signal to obtain the original audio signal in a time domain.

Also, the inverse time-to-frequency converter 1150 restores the audio signal in the frequency domain that is generated by the lossy decoding unit 1110 to the original audio signal in a time domain. The restored audio signal is obtained by lossy decoding.

Figure 12:
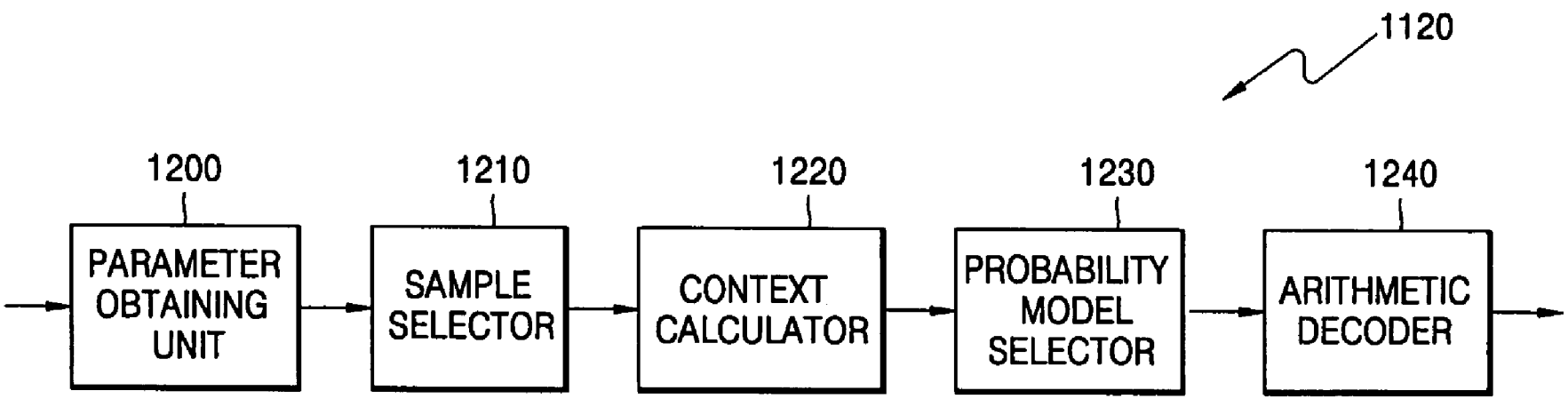
FIG. 12 is a detailed block diagram of a lossless decoding unit of FIG. 11.

FIG. 12 is a detailed block diagram of the lossless decoding unit 1120 of FIG. 11. The lossless decoding unit 1120 includes a parameter obtaining unit 1200, a sample selector 1210, a context calculating unit 1220, a probability model selector 1230, and an arithmetic decoder 1240.

The parameter obtaining unit 1200 obtains an MSB and a Golomb parameter from the audio bitstream. The sample selector 1210 selects binary samples that are to be decoded in sequence from the MSB to an LSB and from a lowest frequency component to a highest frequency component.

The context calculating unit 1220 calculates a predetermined context using already decoded samples. The context calculating unit 1220 includes a first calculator (not shown) and a second context calculator (not shown). The first context calculator computes a first context using previously decoded samples present on the same bit plane including the selected binary samples. The second context calculator computes a second context using already decoded upper bit plane samples at the same frequency where the selected binary samples are present.

The probability model selector 1230 selects a probability model using the Golomb parameter and the first and second context values. The arithmetic decoder 1240 arithmetically decodes the selected binary samples using the probability model.

Figure 13:
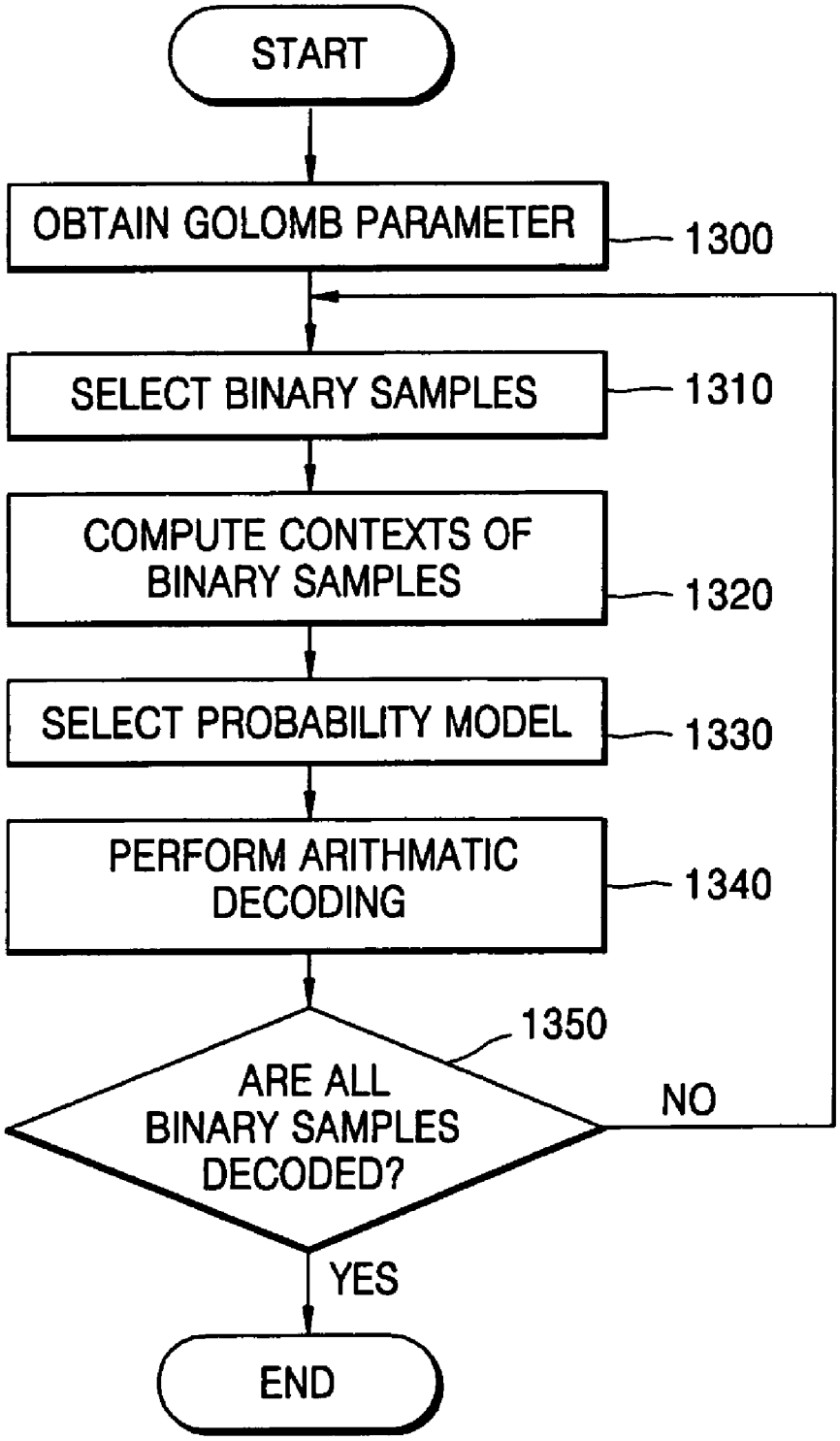
FIG. 13 is a flowchart of an operation of the lossless audio decoding apparatus of FIG. 9, according to an embodiment of the present invention.

FIG. 13 is a flowchart of an operation of the lossless audio decoding apparatus of FIG. 9, according to an embodiment of the present invention. Referring to FIG. 13, when a bitstream of audio data is input to the parameter obtaining unit 900, a Golomb parameter is obtained form the bitstream (operation 1300). Next, the sample selector 910 selects binary samples that are to be decoded in sequence from an MSB to an LSB and from a lowest frequency component to a highest frequency component (operation 1310).

After the selection of the binary samples, the context calculator 920 computes predetermined contexts using already decoded samples (operation 1320). Here, the predetermined contexts include a first context and a second context. The first context is computed by the first context calculator 1000 of FIG. 10 using already decoded samples present on the same bit plane including the selected binary samples. The second context is computed by the second context calculator 1020 of FIG. 10 using already decoded upper bit plane samples at the same frequency where the selected binary samples are located.

Next, the probability model selector 930 selects a probability model using the Golomb parameter and the first and second contexts (operation 1330). Next, the selected binary samples are arithmetically decoded using the probability model (operation 1340). Operations 1310 through 1340 are repeated until all binary samples selected to bit planes are decoded (operation 1350).

Figure 14:
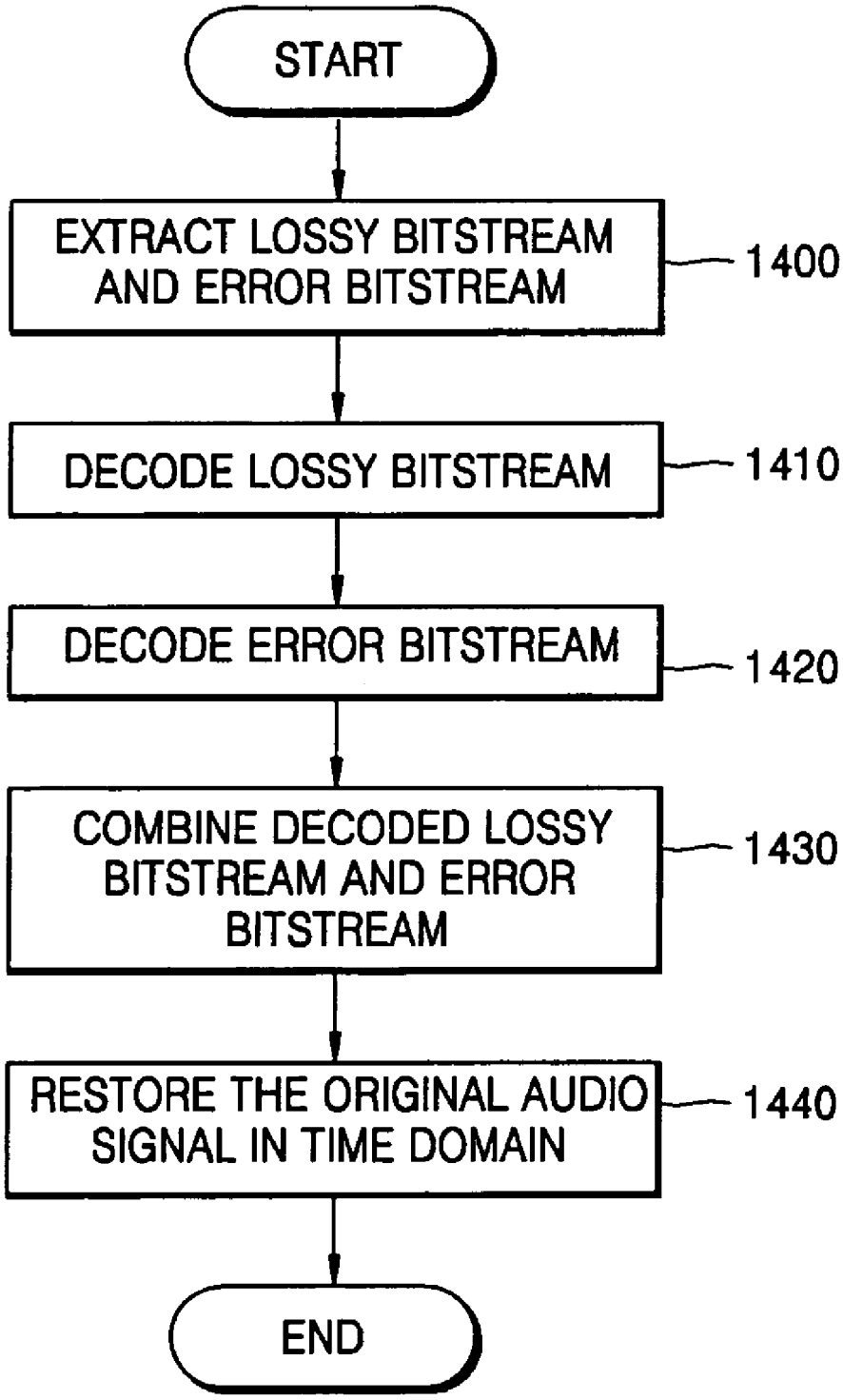
FIG. 14 is a flowchart of an operation of the lossless audio decoding apparatus of FIG. 11, according to an embodiment of the present invention.

FIG. 14 is a flowchart of an operation of the lossless audio decoding apparatus of FIG. 11, according to an embodiment of the present invention. In this embodiment, the difference between lossy encoded audio data and an audio spectral signal with an integer in a frequency domain will be referred to as error data. Referring to FIG. 14, when an audio bitstream is input to the demultiplexer 1100, the bitstream is demultiplexed to extract a lossy bitstream generated using a predetermined lossy encoding method and an error bitstream of the error data (operation 1400).

Next, when the extracted lossy bitstream is input to the lossy decoding unit 1110 and lossy decoded by the lossy decoding unit 1110 using a predetermined lossy decoding corresponding to a lossy encoding method adopted to encode the bitstream (operation 1410). Also, the extracted error bitstream is input to the lossless decoding unit 1120 and losslessly decoded by the lossless decoding unit 1120 (operation 1420). Operation 1420 is similar to the operations of FIG. 13, and thus, a detailed description thereof will be omitted.

Next, the lossy bitstream generated by the lossy decoding unit 1110 and the error bitstream generated by the lossless decoding unit 1120 are input to the audio signal composition unit 1130 so as to restore the original frequency spectral signal (operation 1430). The frequency spectral signal is input to the inverse integer time-to-frequency converter 1140 to restore the original audio signal in a time domain (operation 1440).

Embodiments of the present invention can be embodied as computer readable code/instructions in a medium, e.g., a computer readable medium. Here, the computer may be any apparatus that can process information. Also, the medium may be any apparatus capable of storing/transferring data that is readable by a computer system, e.g., a read-only memory (ROM), a random access memory (RAM), a compact disc (CD)-ROM, a magnetic tape, a floppy disk, an optical data storage device, etc.

Lossless audio encoding/decoding methods, media, and apparatuses, according to embodiments of the present invention are capable of encoding/decoding audio signals at optimum compression rates using a probability model based on a statistical distribution of integer MDCT coefficients, rather than a substantial distribution of integer MDCT coefficients. That is, it is possible to achieve optimum compression rates regardless of whether the integer MDCT coefficients show the Laplacian distribution. Accordingly, it is possible to compress audio signals at optimum compression rates using context-based encoding better than when using BPGC.

The following pseudo code presents an example of use for a lossless encoding unit (arithmetic encoding unit) and a context model to perform lossless audio decoding, according to an embodiment of the present invention. Embodiments of the present invention are also applicable to the MPEG-4 audio scalable to lossless audio compression standard.

Pseudo code for context-dependent entropy coding:

```
  while (there exists cur_bp[g][sfb] >= 0){
for (g=0;g<num_windows_group;g++){
  for (sfb = 0;sfb<total_sfb;sfb++){
    if (cur_bp[g][sfb]>=0 && low_energy_mode_used != 1){
      width = swb_offset[g][sfb+1] ? swb_offset[g][sfb];
        for (win=0;win<window_group_len[g];win++){
          for (bin=0;bin<width;bin++){
            if (!is_lle_ics_eof ( )){
              if (M[g][win][sfb][bin] >=cur_bp[g][sfb]){
                context1 = Context1_Calculation( );
                  probVal = model_select(context);
  res[g][win][sfb][bin] += bpgc_decode(probVal)<<cur_bp[g][sfb];
                /* decode bit-plane cur_bp*/
                    if ((!is_sig[g][win][sfb][bin]) &&
                    (res[g][win][sfb][bin] )) {
                    res[g][win][sfb][bin] *= (bpgc_decode( ))? 1:-1;
                      is_sig[g][win][sfb][bin] = 1;
                                }
              else { /* lossy mode */
                    if (is_sig[g][win][sfb][bin]){
                              res[g][win][sfb][bin] += res_fill;
                              is_sig[g][win][sfb][bin] = 0;
                                        }
                                    }
                                  }
                                }
                              }
      cur_bp[g][sfb]--; /* progress to next bit-plane */
                        }
                      }
            if(low_energy_mode_used)
            {
                    decode_low_energy_mode( );
            }
      }
  }
```

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A lossless audio encoding method performed by a lossless audio encoding apparatus, comprising:

mapping an audio spectral signal received by the lossless audio encoding apparatus in a frequency domain to a bit plane signal according to frequency;

obtaining a most significant bit and a golumb parameter for each of the bit planes;

selecting binary samples that are to be encoded from bit planes in sequence from a most significant bit to a least significant bit and from a lowest frequency component to a highest frequency component;

computing a context of the selected binary samples using already encoded samples;

selecting a probability model using the golomb parameter and the context; and losslessly encoding the selected binary samples using the probability model, wherein during the computing of the context of the selected binary samples, the context of the selected binary samples is computed using information regarding whether already encoded upper bit plane values at a frequency are present, and the context is determined to have a value of 1 when at least one of the upper bit plane values is 1, and determined to have a value of 0 otherwise.

2. The lossless audio encoding method of claim 1, further comprising converting an audio signal in a time domain into the audio spectral signal with an integer in the frequency domain.

3. A medium comprising computer readable code implementing the method of claim 1.

4. A lossless audio encoding method performed by a lossless audio encoding apparatus comprising:

scaling an audio spectral signal received by the lossless audio encoding apparatus in a frequency domain so that it can be matched for input to a lossy encoding unit;

lossy encoding the scaled signal to obtain lossy encoded data;

computing an error-mapped signal that is a difference between the lossy encoded data and the audio spectral signal with the integer in the frequency domain;

mapping the error-mapped signal to data of bit planes signal according to frequency;

obtaining a most significant bit and a golumb parameter for each of the bit planes;

selecting binary samples that are to be encoded from bit planes in sequence from a most significant bit to a least significant bit and from a lowest frequency component to a highest frequency component;

computing a context of the selected binary samples using already encoded samples;

selecting a probability model using the golomb parameter and the context;

losslessly encoding the selected binary samples using the probability model; and multiplexing the losslessly encoded signal and the lossy encoded signal to make a bitstream, wherein during the computing of the context of the selected binary samples, the context of the selected binary samples is computed using information regarding whether already encoded upper bit plane values at a frequency are present, and the context is determined to have a value of 1 when at least one of the upper bit plane values is 1, and determined to have a value of 0 otherwise.

5. The lossless audio encoding method of claim 4, further comprising converting an audio signal in a time domain to the audio spectral signal with an integer in the frequency domain.

6. The lossless audio encoding method of claim 5, wherein during the computing of the context of the selected binary samples, a scalar value of the previously encoded samples present on the bit plane including the selected binary samples is obtained and the context of the selected binary samples are computed using the scalar value.

7. A medium comprising computer readable code implementing the method of claim 4.

8. A lossless audio encoding method performed by a lossless audio encoding apparatus comprising:

scaling an audio spectral signal received by the lossless audio encoding apparatus in a frequency domain so that it can be matched for input to a lossy encoding unit;

lossy encoding the scaled signal to obtain lossy encoded data;

computing an error-mapped signal that is a difference between the lossy encoded data and the audio spectral signal with the integer in the frequency domain;

mapping the error-mapped signal to data of bit planes signal according to frequency;

obtaining a most significant bit and a golumb parameter for each of the bit planes;

selecting binary samples that are to be encoded from bit planes in sequence from a most significant bit to a least significant bit and from a lowest frequency component to a highest frequency component;

computing a context of the selected binary samples using already encoded samples;

selecting a probability model using the golomb parameter and the contexts;

losslessly encoding the selected binary samples using the probability model; and multiplexing the losslessly encoded signal and the lossy encoded signal to make a bitstream, wherein during the computing of the context of the selected binary samples, a probability that predetermined samples will have a value of 1 is computed, the probability is multiplied by a predetermined integer to obtain an integral probability, and the context of the selected binary samples is computed using the integral probability, the predetermined samples being present on the bit plane including the selected binary samples.

9. A lossless audio encoding apparatus comprising:

a lossless encoding unit mapping an audio spectral signal in a frequency domain to data of bit planes according to frequency, obtaining a most significant bit and a golumb parameter for each of the bit planes, selecting binary samples that are to be encoded from bit planes in sequence from a most significant bit to a least significant bit and from a lowest frequency component to a highest frequency component, computing a context of the selected binary samples using already encoded samples; selecting a probability model using the golomb parameter and the contexts, and arithmetically encoding the selected binary samples using the probability model, wherein during the computing of the context of the selected binary samples, the context of the selected binary samples is computed using information regarding whether already encoded upper bit plane values at a frequency are present, and the context is determined to have a value of 1 when at least one of the upper bit plane values is 1, and determined to have a value of 0 otherwise.

10. The lossless audio encoding apparatus of claim 9, further comprising an integer time-to-frequency converter converting an audio signal in a time domain into the audio spectral signal with an integer in the frequency domain.

11. The lossless audio encoding apparatus of claim 10, wherein the integer time-to-frequency converter performs integer modified discrete cosine transform.

12. A lossless audio encoding apparatus comprising:

a scaling unit scaling an audio spectral signal so that the audio spectral signal can be matched for input to a lossy encoding unit;

the lossy encoding unit lossy encoding the scaled signal;

an error mapper computing a error-mapped signal that is a difference between the lossy encoded signal and the audio spectral signal;

a lossless encoding unit mapping the error-mapped signal to data of bit planes signal according to frequency, obtaining a most significant bit and a golumb parameter for each of the bit planes, selecting binary samples that are to be encoded from bit planes in sequence from a most significant bit to a least significant bit and from a lowest frequency component to a highest frequency component, computing a context of the selected binary samples using already encoded samples, selecting a probability model using the golomb parameter and the contexts, and arithmetically encoding the selected binary samples using the probability model; and a multiplexer multiplexing the lossy encoded signal and the losslessly encoded signal to make a bitstream, wherein during the computing of the context of the selected binary samples, the context of the selected binary samples is computed by computing a probability that predetermined samples on a plane have a value of 1, multiplying the probability by a predetermined integer to obtain an integral probability, and computing the context using the integral probability.

13. The apparatus of claim 12, further comprising an integer time-to-frequency converter converting an audio signal in a time domain into the audio spectral signal with an integer in a frequency domain.

14. A lossless audio encoding apparatus comprising:

a scaling unit scaling an audio spectral signal so that the audio spectral signal can be matched for input to a lossy encoding unit; the lossy encoding unit lossy encoding the scaled signal;

an error mapper computing a error-mapped signal that is a difference between the lossy encoded signal and the audio spectral signal; and a lossless encoding unit mapping the error-mapped signal to data of bit planes signal according to frequency, obtaining a most significant bit and a golumb parameter for each of the bit planes, selecting binary samples that are to be encoded from bit planes in sequence from a most significant bit to a least significant bit and from a lowest frequency component to a highest frequency component, computing predetermined contexts using already encoded samples, selecting a probability model using the golomb parameter and the contexts, and arithmetically encoding the selected binary samples using the probability model; and a multiplexer multiplexing the lossy encoded signal and the losslessly encoded signal to make a bitstream, wherein during the computing of the context of the selected binary samples, the context of the selected binary samples is computed using information regarding whether the already encoded upper bit plane values are present at a frequency where the selected binary samples are located, and the context is determined to have a value of 1 when at least one of the upper bit plane values is 1 and have a value of 0 otherwise.

15. A lossless audio decoding method performed by a lossless audio decoding apparatus comprising:

obtaining a golomb parameter from audio data received by the lossless audio decoding apparatus;

selecting binary samples that are to be decoded from bit planes in sequence from a most significant bit to a least significant bit and from a lowest frequency component to a highest frequency component;

computing predetermined contexts using already decoded samples;

selecting a probability model using the golomb parameter and the contexts;

arithmetically decoding the selected binary samples using the probability model; and repeatedly performing the selecting of binary samples, the computing of a predetermined contexts, the selecting of a probability model, and the arithmetically decoding of the selected binary samples until all the selected binary samples are decoded, wherein during the computing of the predetermined contexts, the context of the selected binary samples is computed using information regarding whether already decoded upper bit plane values at a frequency are present, and the context is determined to have a value of 1 when at least one of the upper bit plane values is 1, and determined to have a value of 0 otherwise.

16. The lossless audio decoding method of claim 15, wherein the computing of the predetermined contexts comprises:

computing a first context using already decoded samples present on a bit plane including the selected binary samples; and computing a second context using already decoded upper bit plane samples at a frequency where the selected binary samples are located.

17. A medium comprising computer readable code implementing the method of claim 15.

18. A lossless audio decoding method performed by a lossless audio decoding apparatus comprising:

extracting a predetermined lossy bitstream that is lossy encoded and an error bitstream from error data by demultiplexing an audio bitstream received by the lossless audio decoding apparatus, the error data corresponding to a difference between lossy encoded audio data and an audio spectral signal with an integer in a frequency domain;

lossy decoding the extracted encoded lossy bitstream;

obtaining a golomb parameter from a bitstream of the audio data;

selecting binary samples that are to be decoded in sequence from a most significant bit to a least significant bit and from a lowest frequency component to a highest frequency component;

computing predetermined contexts using already decoded samples;

selecting a probability model using the golomb parameter and the contexts;

losslessly decoding the extracted error bitstream using the probability model; and restoring an original audio frequency spectral signal using the decoded lossy bitstream and error bitstream, wherein during the computing of the predetermined contexts, the context of the selected binary samples is computed using information regarding whether already decoded upper bit plane values at a frequency are present, and the context is determined to have a value of 1 when at least one of the upper bit plane values is 1, and determined to have a value of 0 otherwise.

19. The lossless audio decoding method of claim 18, further comprising restoring an original audio signal in a time domain by performing inverse integer time-to-frequency conversion on the audio spectral signal.

20. The lossless audio decoding method of claim 18, wherein the computing of the predetermined contexts comprises computing a first context using already decoded samples on a bit plane including the selected binary samples.

21. The lossless audio decoding method of claim 18, wherein the computing of the predetermined contexts comprises computing a second context using already decoded upper bit plane samples at a frequency where the selected binary samples are located.

22. The lossless audio decoding method of claim 18, wherein the computing of the predetermined contexts comprises:

computing a first context using already decoded samples on a bit plane including the selected binary samples; and computing a second context using already decoded upper bit plane samples at a frequency where the selected binary samples are located.

23. A medium comprising computer readable code implementing the method of claim 18.

24. A lossless audio decoding apparatus comprising:

a parameter obtaining unit obtaining a golomb parameter from a bitstream of audio data;

a sample selector selecting binary samples that are to be decoded in sequence from a most significant bit to a least significant bit and from a lowest frequency component to a highest frequency component;

a context calculating unit computing predetermined contexts using already decoded samples;

a probability model selector selecting a probability model using the golomb parameter and the contexts; and an arithmetic decoder arithmetically decoding the selected binary samples using the probability model, wherein during the computing of the predetermined contexts, the context of the selected binary samples is computed using information regarding whether already decoded upper bit plane values at a frequency are present, and the context is determined to have a value of 1 when at least one of the upper bit plane values is 1, and determined to have a value of 0 otherwise.

25. The lossless audio decoding apparatus of claim 24, wherein the context calculating unit comprises:

a first context calculator computing a first context using already decoded samples present on a bit plane including the selected binary samples; and a second context calculator computing a second context using already decoded upper bit plane samples at a frequency where the selected binary samples are located.

26. A lossless audio decoding apparatus comprising:

a demultiplexer demultiplexing an audio bitstream to extract a predetermined lossy bitstream that is lossy encoded and an error bitstream from error data which corresponds to a difference between lossy encoded audio data and an audio spectral signal with an integer in a frequency domain;

a lossy decoding unit lossy encoding the extracted lossy bitstream;

a lossless decoding unit obtaining a golomb parameter from a bitstream of the audio data, selecting binary samples that are to be decoded in sequence from a most significant bit to a least significant bit and from a lowest frequency component to a highest frequency component, computing predetermined contexts using already decoded samples, selecting a probability model using the golomb parameter and the contexts, and losslessly decoding the extracted error bitstream using the probability model; and an audio signal composition unit combining the decoded lossy bitstream and error bitstream to restore the audio spectral signal, wherein during the computing of the predetermined contexts, the context of the selected binary samples is computed using information regarding whether already decoded upper bit plane values at a frequency are present, and the context is determined to have a value of 1 when at least one of the upper bit plane values is 1, and determined to have a value of 0 otherwise.

27. The lossless audio decoding apparatus of claim 26, further comprising an inverse integer time-to-frequency converter performing inverse integer time-to-frequency conversion on the restored audio spectral signal to restore an original audio signal in a time domain.

28. The lossless audio decoding apparatus of claim 26, wherein the lossy decoding unit is an AAC decoder.

29. The lossless audio decoding apparatus of claim 26, wherein the context calculating unit comprises:

a first context calculator computing a first context using already decoded samples present on a bit plane including the selected binary samples; and a second context calculator computing a second context using already decoded upper bit plane samples at a frequency where the selected binary samples are located.

30. A lossless audio decoding method performed by a lossless audio decoding apparatus comprising:

obtaining a lazy bit-plane from audio data received by the lossless audio decoding apparatus;

selecting bit-plane symbols that are to be decoded from bit planes in sequence from a most significant bit to a least significant bit;

determining contexts using already decoded bit-plane symbols, and selecting a probability model of bit-plane symbols using the contexts; and arithmetically decoding the selected bit-plane symbols using the probability model, wherein during the determining of the contexts, the context of the selected bit-plane symbols is computed using information regarding whether already decoded upper bit plane values at a frequency are present, and the context is determined to have a value of 1 when at least one of the upper bit plane values is 1, and determined to have a value of 0 otherwise.

31. A lossless audio decoding method performed by a lossless audio decoding apparatus comprising:

obtaining a lazy bit-plane from audio data received by the lossless audio decoding apparatus;

selecting binary samples that are to be decoded from bit planes in sequence from a most significant bit to a least significant bit;

determining contexts using already decoded binary samples, and selecting a probability model of binary samples using the contexts; and arithmetically decoding the selected binary samples using the probability model, wherein during the determining of the contexts, the context of the selected binary samples is computed using information regarding whether already decoded upper bit plane values at a frequency are present, and the context is determined to have a value of 1 when at least one of the upper bit plane values is 1, and determined to have a value of 0 otherwise.

32. A lossless audio decoding method performed by a lossless audio decoding apparatus comprising:

obtaining a lazy bit-plane from audio data received by the lossless audio decoding apparatus;

selecting bit-plane symbols that are to be decoded from bit planes in sequence from a most significant bit to a least significant bit;

determining contexts using already decoded bit-plane symbols, and selecting a probability model of bit-plane symbols using the contexts; and arithmetically decoding the selected bit-plane symbols using the probability model, wherein the selecting of the bit-plane symbols, the determining of the contexts, and the arithmetically decoding of the selected bit-plane symbols are performed repeatedly until all the selected bit-plane symbols are decoded, and wherein during the determining of the contexts, the context of the selected bit-plane symbols is computed using information regarding whether already decoded upper bit plane values at a frequency are present, and the context is determined to have a value of 1 when at least one of the upper bit plane values is 1, and determined to have a value of 0 otherwise.

33. A lossless audio decoding method performed by a lossless audio decoding apparatus comprising:

obtaining a lazy bit-plane from audio data received by the lossless audio decoding apparatus;

selecting binary samples that are to be decoded from bit planes in sequence from a most significant bit to a least significant bit;

determining contexts using already decoded binary samples, and selecting a probability model of binary samples using the contexts; and arithmetically decoding the selected binary samples using the probability model, wherein the selecting of the binary samples, the determining of the contexts, and the arithmetically decoding of the selected binary samples are performed repeatedly until all the selected binary samples are decoded, and wherein during the determining of the contexts, the context of the selected binary samples is computed using information regarding whether already decoded upper bit plane values at a frequency are present, and the context is determined to have a value of 1 when at least one of the upper bit plane values is 1, and determined to have a value of 0 otherwise.

34. A medium comprising computer readable code to implement a lossless audio decoding method, the method comprising:

obtaining a lazy bit-plane from audio data;

selecting bit-plane symbols that are to be decoded from bit planes in sequence from a most significant bit to a least significant bit;

determining contexts using already decoded bit-plane symbols, and selecting a probability model of bit-plane symbols using the contexts; and arithmetically decoding the selected bit-plane symbols using the probability model, wherein during the determining of the contexts, the context of the selected bit-plane symbols is computed using information regarding whether already decoded upper bit plane values at a frequency are present, and the context is determined to have a value of 1 when at least one of the upper bit plane values is 1, and determined to have a value of 0 otherwise.

35. A medium comprising computer readable code to implement a lossless audio decoding method, the method comprising:

obtaining a lazy bit-plane from audio data;

selecting binary samples that are to be decoded from bit planes in sequence from a most significant bit to a least significant bit;

determining contexts using already decoded binary samples, and selecting a probability model of binary samples using the contexts; and arithmetically decoding the selected binary samples using the probability model, wherein during the determining of the contexts, the context of the selected binary samples is computed using information regarding whether already decoded upper bit plane values at a frequency are present, and the context is determined to have a value of 1 when at least one of the upper bit plane values is 1, and determined to have a value of 0 otherwise.

36. A medium comprising computer readable code to implement a lossless audio decoding method, the method comprising:

obtaining a lazy bit-plane from audio data;

selecting bit-plane symbols that are to be decoded from bit planes in sequence from a most significant bit to a least significant bit;

determining contexts using already decoded bit-plane symbols, and selecting a probability model of bit-plane symbols using the contexts; and arithmetically decoding the selected bit-plane symbols using the probability model, wherein the selecting of the bit-plane symbols, the determining of the contexts, and the arithmetically decoding of the selected bit-plane symbols are performed repeatedly until all the selected bit-plane symbols are decoded, and wherein during the determining of the contexts, the context of the selected bit-plane symbols is computed using information regarding whether already decoded upper bit plane values at a frequency are present, and the context is determined to have a value of 1 when at least one of the upper bit plane values is 1, and determined to have a value of 0 otherwise.

37. A medium comprising computer readable code to implement a lossless audio decoding method, the method comprising:

obtaining a lazy bit-plane from audio data;

selecting binary samples that are to be decoded from bit planes in sequence from a most significant bit to a least significant bit;

determining contexts using already decoded binary samples, and selecting a probability model of binary samples using the contexts; and arithmetically decoding the selected binary samples using the probability model, wherein the selecting of the binary samples, the determining of the contexts, and the arithmetically decoding of the selected binary samples are performed repeatedly until all the selected binary samples are decoded, and wherein during the determining of the contexts, the context of the selected binary samples is computed using information regarding whether already decoded upper bit plane values at a frequency are present, and the context is determined to have a value of 1 when at least one of the upper bit plane values is 1, and determined to have a value of 0 otherwise.

* * * * *

UNITED STATES PATENT AND TRADEMARK OFFICE

CERTIFICATE OF CORRECTION

PATENT NO. : 7,617,110 B2
APPLICATION NO. : 11/066431
DATED : November 10, 2009
INVENTOR(S) : Junghoe Kim et al.

It is certified that error appears in the above-identified patent and that said Letters Patent is hereby corrected as shown below:

Column 13, Line 53, change "golumb" to --golomb--.

Column 14, Line 24, change "golumb" to --golomb--.

Column 15, Line 3, change "golumb" to --golomb--.

Column 15, Line 28, change "golumb" to --golomb--.

Column 15, Line 63, change "golumb" to --golomb--.

Column 16, Line 24, change "a" to --an--.

Column 16, Line 29, change "golumb" to --golomb--.

Signed and Sealed this

Ninth Day of February, 2010

David J. Kappos

David J. Kappos
*Director of the United States Patent and Trademark Office*